US006227694B1

(12) United States Patent
Mitake et al.

(10) Patent No.: US 6,227,694 B1
(45) **Date of Patent: *May 8, 2001**

(54) HIGH SPEED COLLISION REACTION METHOD

(75) Inventors: Kazutoshi Mitake; Fuminori Miyake; Fumio Yasuda, all of Itabashi-ku; Tatsuo Yazaki; Megumu Toda, both of Osaka, all of (JP)

(73) Assignees: Genus Corporation, Tokyo-to (JP); Hakusui Tech Co., Ltd., Osaka-fu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/995,694

(22) Filed: Dec. 22, 1997

(30) Foreign Application Priority Data

Dec. 27, 1996 (JP) ..... 8-351502
Mar. 24, 1997 (JP) ..... 9-070154

(51) Int. Cl.[7] ..... B01F 15/02
(52) U.S. Cl. ..... 366/162.4; 366/173.1
(58) Field of Search ..... 366/162.4, 173.1; 261/18.1, 40; 422/131, 135, 140, 142, 145, 149, 156

(56) References Cited

U.S. PATENT DOCUMENTS

| | | | | |
|---|---|---|---|---|
| 2,751,335 | * | 6/1956 | Carver et al. | 366/162.4 |
| 3,190,846 | * | 6/1965 | Lipton et al. | 366/173.1 |
| 3,306,342 | * | 2/1967 | Savlo et al. | 366/173.1 |
| 3,410,531 | * | 11/1968 | Baker | 366/162.4 |
| 3,692,283 | * | 9/1972 | Sauer et al. | 366/173.1 |
| 3,833,718 | * | 9/1974 | Reed | 366/162.4 |
| 3,847,375 | * | 11/1974 | Kuerten et al. | 366/167.1 |
| 3,849,074 | * | 11/1974 | Ficklinger et al. | 366/162.4 |
| 4,043,486 | * | 8/1977 | Wisbey | 366/162.4 |
| 4,289,732 | * | 9/1981 | Bauer et al. | 366/162.4 |
| 4,378,335 | * | 3/1983 | Boden et al. | 366/162.4 |
| 4,440,320 | * | 4/1984 | Wernicke | 366/162.4 |
| 4,474,310 | * | 10/1984 | Muller et al. | 366/162.4 |
| 4,523,696 | * | 6/1985 | Commette et al. | 366/162.4 |
| 4,568,003 | * | 2/1986 | Sperry et al. | 366/162.4 |
| 4,595,565 | * | 6/1986 | Tenhagen | 366/162.4 |
| 4,773,564 | * | 9/1988 | Wallner | 366/162.4 |
| 4,854,713 | * | 8/1989 | Soechtig | 366/162.4 |
| 4,876,071 | * | 10/1989 | Toda et al. | 366/162.4 |
| 5,181,987 | * | 1/1993 | Breuker et al. | 366/162.4 |
| 5,223,550 | * | 6/1993 | Hughes et al. . | |
| 5,246,673 | | 9/1993 | Hed . | |
| 5,312,596 | * | 5/1994 | Proksa et al. | 366/162.4 |
| 5,380,089 | * | 1/1995 | Karasawa | 366/162.4 |
| 5,562,883 | * | 10/1996 | Salisbury et al. | 366/173.1 |

FOREIGN PATENT DOCUMENTS

| | | |
|---|---|---|
| 3633343 | 3/1988 | (DE) . |
| 0344898 | 12/1989 | (EP) . |
| 63-278534 | 11/1988 | (JP) . |
| 4-139441 | 5/1992 | (JP) . |
| WO 8809208 | 12/1988 | (WO) . |
| WO 9407582 | 4/1994 | (WO) . |

OTHER PUBLICATIONS

Patent Abstracts Of Japan, vol. 013, No. 105 (C–575), Mar. 13, 1989 & JP 63 278534 A (Nordson KK), Nov. 16, 1988.
Patent Abstracts Of Japan, vol. 015, No. 012 (C–0795), Jan. 10, 1991 & JP 02 261525 A (Cosmo Keiso KK), Oct. 24, 1990.

* cited by examiner

*Primary Examiner*—Tony G. Soohoo
(74) *Attorney, Agent, or Firm*—Jordan and Hamburg LLP

(57) ABSTRACT

Two or more substances are flowed from different inflow passages, and collided against each other at a flow rate of 4 m/sec or higher to cause a uniform reaction with each other for a short time. This method is advantageous for producing a dispersion liquid containing very fine particles the size of submicrons.

28 Claims, 10 Drawing Sheets

HIGH SPEED COLLISION REACTION METHOD

BACKGROUND OF THE INVENTION

This invention relates to a high speed collision reaction method for causing a chemical reaction between two kinds of substance by high speed collision.

To mix and react two or more reactive substances, there has been known a method which uses a batch-type reactor including an agitation chamber. In this method, two or more substances are supplied into the agitation chamber simultaneously or successively, and are reacted with each other by agitation in the agitation chamber. Also, there has been known a method which uses a reactor including an agitation flow passage, such as a static mixer. The agitation flow passage is provided with blades therein to cause turbulence. In this method, two or more substances are flowed in the agitation flow passage, and are reacted with each other by agitation in the agitation flow passage.

In the method using a batch-type reactor, two or more substances are supplied from different sources into a fixed volume agitation chamber simultaneously or successively, and are agitated for a specified time to cause a reaction between the substances. When the reaction is completed or reaches an equilibrium state, a product is removed. However, this method has the following problems. If a state change occurs in a reaction system, e.g., the viscosity of the reactive substance increases or the substances are not agitated uniformly, the reaction efficiency consequently decreases. Also, if an unmixable part is created and remains in a reaction system for a long time, the unmixable part aggregates into a considerable mass, thus making it difficult to produce a finely dispersed mixture.

Further, keeping the reaction system in the fixed chamber for a long time inevitably causes changes in the physical and chemical conditions. For example, the amount, concentration, and pH of reactive substances will vary over time. It is very difficult to maintain the reaction system at constant conditions. In the batch-type reaction method, in principle, the reaction is conducted per batch. To improve this drawback, there has been proposed a reactor system in which a plurality of agitation chambers are connected in series to perform a continuous reaction. In this case, however, the concentration of reactive substances changes as they travel from an initial chamber to a final chamber. Usually, the concentration decreases toward the final chamber. Accordingly, the reaction efficiency decreases toward the final chamber. Thus, it has been very difficult to attain the required reaction efficiency.

On the other hand, the method using the agitation flow passage also has the following problems. In this method, blades or other special elements are provided in the agitation flow passage to forcibly generate turbulence. A primary substance is flowed in a direction or circulated in the agitation flow passage while it is in a state of turbulence. A secondary substance is joined to the flow of the primary substance to cause a reaction between the substances. However, contact between the primary substance and the secondary substance inevitably occurs before the secondary substance enters the region of turbulence, consequently causing a heterogeneous reaction for a short time. Further, even if two or more substances come into contact at the same time to cause a homogeneous reaction, a high reaction efficiency cannot be attained.

There has been known another method which uses an ejector. In this method, a large flow of primary substance is produced. A secondary substance is ejected into the large flow of primary substance at a high speed to react with the primary substance. However, this method is not suitable when the substances have a high viscosity or when the reaction product has a high viscosity. Further, the control of substance mixing proportion is very difficult. Accordingly, this method cannot be applied in other than a limited field.

SUMMARY OF THE INVENTION

It is an object of the present invention to provide a high speed collision reaction method which has overcome the problems in the prior art.

According to an aspect of the present invention, a method for causing a reaction between two or more reactive substances comprises the step of colliding a flow of one reactive substance against a flow of another reactive substance at a high flow rate to cause a reaction between them.

In this method, the flows of reactive substances are collided against each other at a high speed to cause a reaction. Accordingly, very fine particles can be produced more efficiently. Also, since the reaction is attained for a very short time, the conditions for the reaction can be controlled more easily.

The above and other objects, features and advantages of the present invention will become more apparent upon a reading of the following detailed description and drawings.

DETAILED DESCRIPTION OF THE PREFERRED EMBODIMENTS OF THE PRESENT INVENTION

According to the present invention, flows of two or more substances in the form of liquid and/or gas having a reactivity with each other are joined in such a way that substances collide with each other at a high speed to react with each other.

Figure 1:
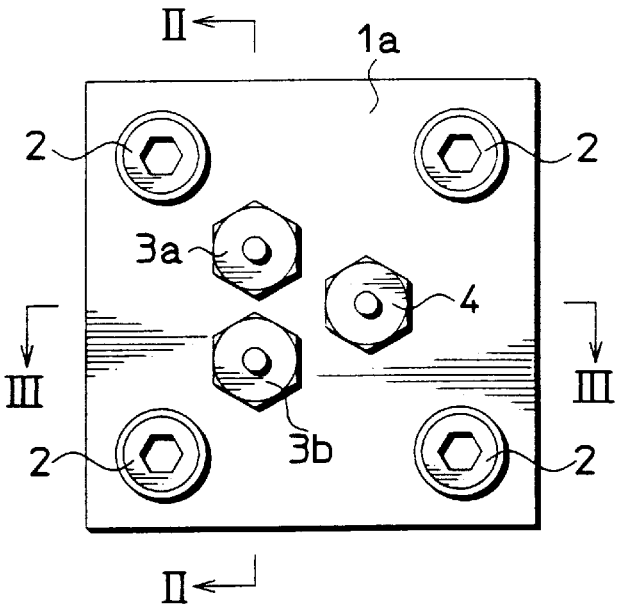
FIG. 1 is a top plan view showing a high speed collision reactor embodying the present invention.
Figure 2:
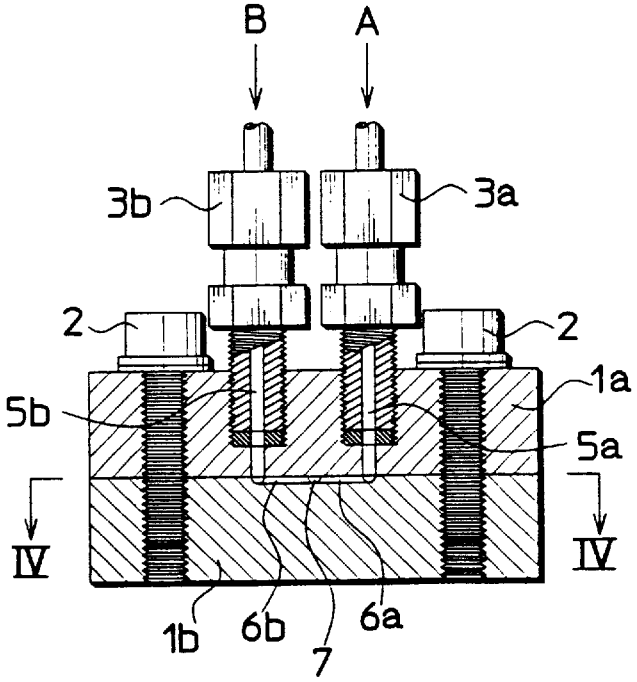
FIG. 2 is a sectional view taken along the line II—II in FIG. 1.
Figure 3:
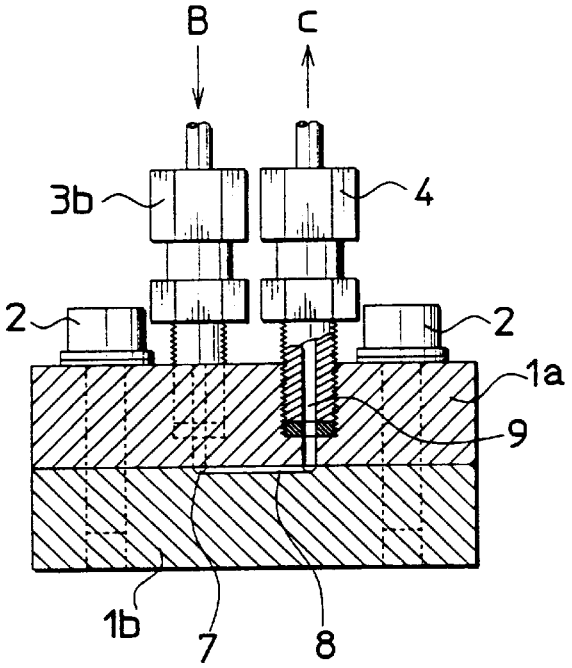
FIG. 3 is a sectional view taken along the line III—III in FIG. 1.
Figure 4:
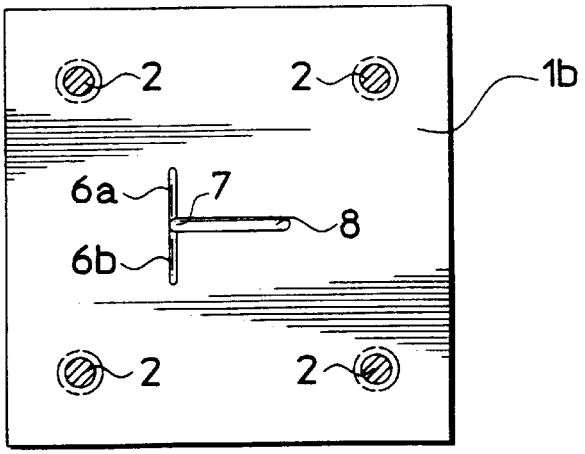
FIG. 4 is a sectional view taken along the line IV—IV in FIG. 2.
Figure 5:
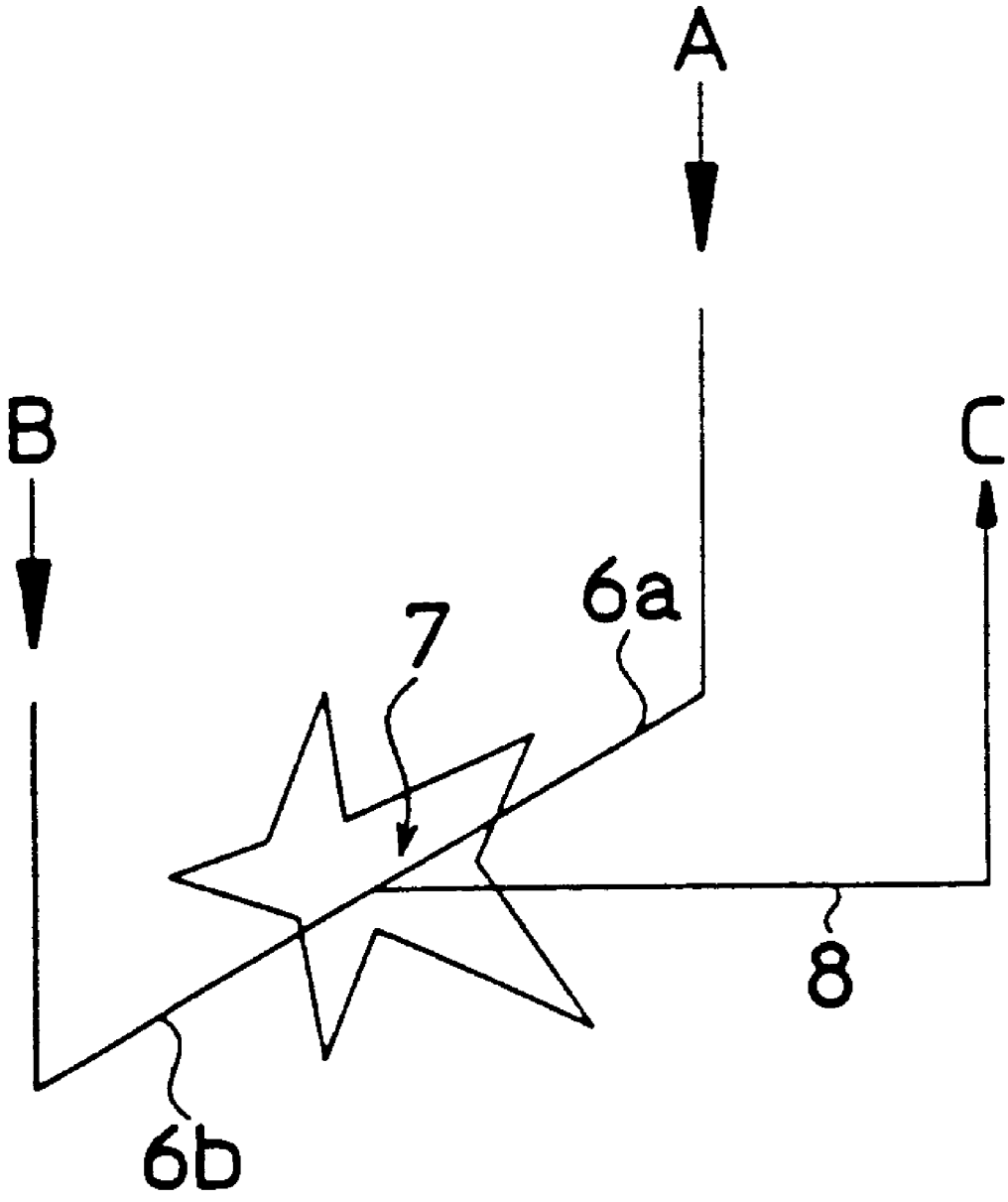
FIG. 5 is a conceptual diagram illustrating a first high speed collision reaction manner embodying the present invention.

FIGS. 1 to 4 show a reactor embodying the present invention. This reactor is configured so as to permit collision reaction between two substances. FIG. 1 is a top plan view of the reactor, FIG. 2 being a sectional view along the line II—II in FIG. 1, FIG. 3 being a sectional view along the line III—III in FIG. 1, and FIG. 4 being a sectional view along the line IV—IV in FIG. 2. This reactor includes two rectangular blocks 1*a* and 1*b* which are assembled into one body by being fastened with four bolts 2 at their respective four corners. The upper block 1*a* is provided with two inlet members 3*a* and 3*b*, and an outlet member 4. The inlet members 3*a* and 3*b* are respectively formed with inflow passages 5*a* and 5*b* which communicate by channels 6*a* and 6*b*. The channels 6*a* and 6*b*, as shown in FIG. 4, extend in opposite directions. From a joining portion 7 of the channels 6*a* and 6*b* extends a channel 8 in a perpendicular direction to the channels 6*a* and 6*b*. The channel 8 communicates with an outflow passage 9 formed in the outlet member 4. Accordingly, flows of the two substances passing through the channels 6*a* and 6*b* collidingly meet each other at the joining portion 7 where reaction occurs. A product C of the reaction flows through the channel 8, as shown in FIG. 5, and the outflow passage 9 to a reservoir arranged outside of the reactor.

Specifically, reactant A and reactant B are respectively supplied into the inflow passages 5*a* and 5*b* at a high speed or high pressure, and flow to the joining portion 7 through the channels 6*a* and 6*b*. The fluids A and B collide at a flow rate of a jet. In the small space of the joining portion 7, the jet flows of the fluids A and B collide with each other at high speed. Also, furious turbulence and cavitation occur in the small space of the joining portion 7. Further, the fluids A and B collide against an inner wall of the joining portion 7. Accordingly, the fluids A and B are mixed at a high kinetic energy, thus causing reaction between the fluids A and B in a very short time. FIG. 5 conceptually shows this high speed collision reaction.

In this high speed collision reaction, the reaction rate and reaction state between the two fluids A and B can be easily controlled in accordance with characteristics of the fluids by adjusting the respective flow rates or kinetic energy of the fluids A and B. Also, the respective supply amounts or proportion of the fluids A and B can be easily controlled by providing supply devices (pumps) for the fluids A and B, respectively.

In this high speed collision reaction, the flow rate of the reactant is important. Specifically, it is desirable to flow fluids at a rate of 4 m/sec or higher, and preferably 7 m/sec or higher, and more preferably 15 m/sec or higher. Such high speed collision reaction makes it possible to produce fine particles the size of submicrons which cannot be produced in the conventional methods.

Further, it may be desirable to suppress or prevent fine particles from aggregating after the reaction, for example, by agitating the fine particles in a large amount of liquid for a short time.

Figure 6:
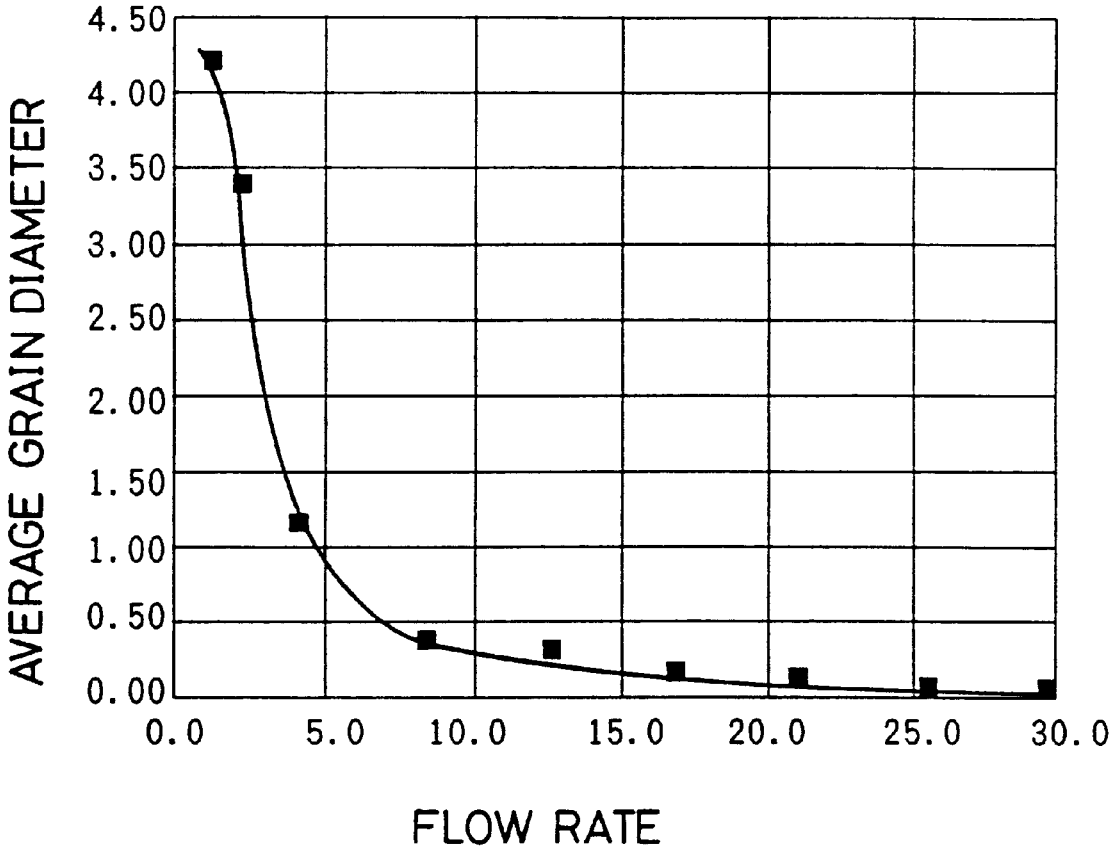
FIG. 6 is a graph illustrating a relationship between the colliding flow rate and the average diameter of produced particles.

FIG. 6 is a graph illustrating a relationship between the flow rate and the average particle diameter. The relationship was obtained in an example where barium chloride and sodium sulfate were collided at a high speed and reacted with each other in the reactor shown in FIGS. 1 to 4, thereby producing barium sulfate. The reaction was conducted at a number of flow rates, and an average particle diameter of resultant barium sulfate at each flow rate was obtained. When the flow rate in the collision reaction is set at 4 m/sec or higher, the average particle diameter was about 1.0 $\mu$m or smaller. When the flow rate was set at 7 m/sec or higher, the average particle diameter was about 0.5 $\mu$m or smaller. When the flow rate was set at 15 m/sec or higher, the average particle diameter was about 0.2 $\mu$m or smaller. From these results, it can be found that the high speed collision reaction of the present invention can produce remarkably fine particles.

On the other hand, the conventional method of reacting two or more substances using jet flows of 1 to 3 m/sec can produce particles not smaller than 3 $\mu$m.

As described above, the high speed collision reaction of the present invention can produce very fine particles the size of submicrons or dispersions including very fine particles. Further, it is possible to add a proper amount of a dispersing agent in a reaction system to prevent secondary agglutination after reaction. In this way, a stable dispersion with very fine particles dispersed therein, which has an appearance similar to an emulsion or a solution, can be obtained.

The flow rate-particle diameter relationship shown in FIG. 6 refers to the production of barium sulfate fine particles from barium chloride and sodium sulfate. Although the diameter of the produced particle slightly varies depending on the reactants, the relationship between the flow rate of the reactants and the diameter of the produced particles is applicable for various kinds of substances. In other words, the diameter of the produced particle noticeably changes above and below the flow rate of 4 m/sec. It has been confirmed that very fine particles, which cannot be produced by conventional methods, can be obtained by colliding material fluids at a flow rate of 4 m/sec or higher.

Accordingly, a feature of the method of the present invention is that the flow rate for the collision reaction of two or more substances is 4 m/sec or higher, preferably 7 m/sec or higher, and more preferably 15 m/sec or higher. The reactor shown in FIGS. 1 to 4 is only an exemplary reactor, and the method of the present invention is not limited to the use of the reactor shown in FIGS. 1 to 4. Any reactor can be used as long as it has such a construction that two or more substances collide at the above-mentioned high speeds to react them in a very short time, and discharge produced particles. As long as such conditions are satisfied, various modifications can be made to the number and the size of inflow passages, the joining direction of reactants, the shape and structure of the joining portion, and the direction of the outflow passage.

However, the reactor shown in FIGS. 1 to 4 is preferable for the method of the present invention because the construction is very simple and the design and production are thus easy. Specifically, the reactor includes the upper and lower blocks 1*a* and 1*b*. The upper block 1*a* is formed with the inflow passages 5*a*, 5*b*, and the outflow passage 9. The lower block 1*b* is formed with the inflow channels 6*a* and 6*b*, the joining portion 7, and the outflow channel 8. Accordingly, the number of inflow passages and channels can be easily changed in accordance with the number of reactants. The inflow channels 6*a* and 6*b*, the joining portion 7, and the outflow channel 8 may be formed in the upper block 1*a* instead of the lower block 1*b*, or may be formed in both the upper block 1*a* and the lower block 1*b*.

Figure 7:
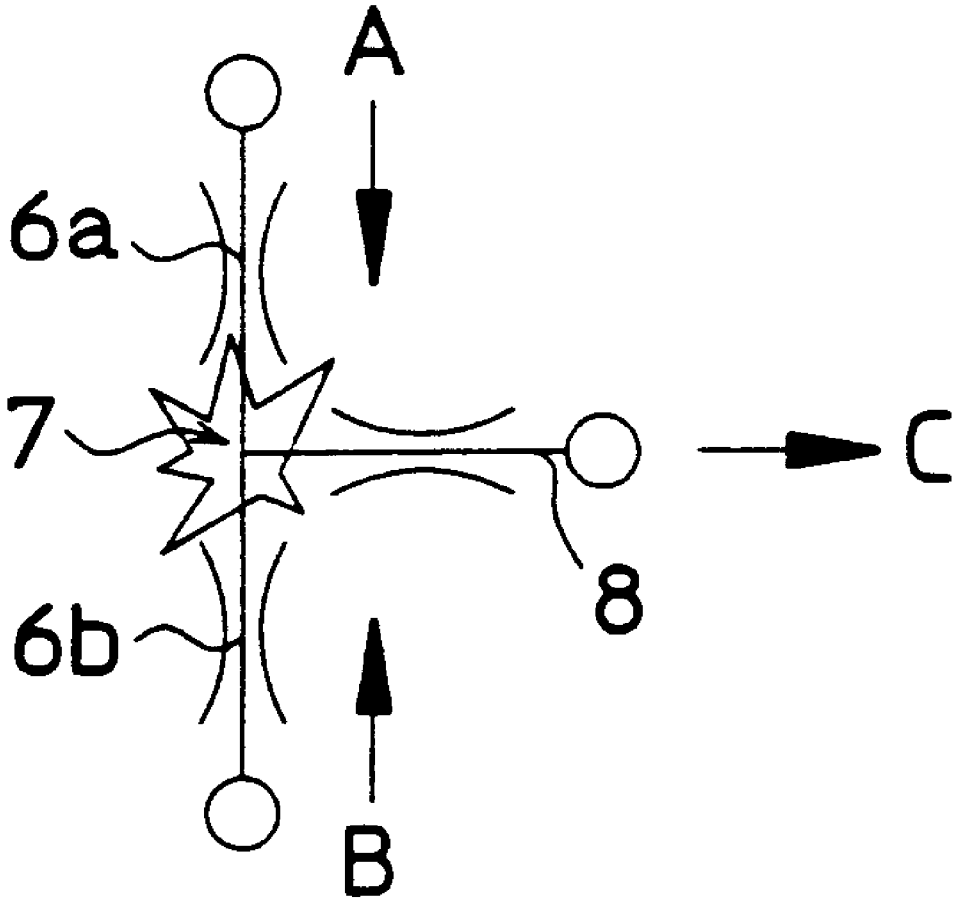
FIG. 7 is a conceptual diagram illustrating a flow control conducted for produced particles.
Figure 8:
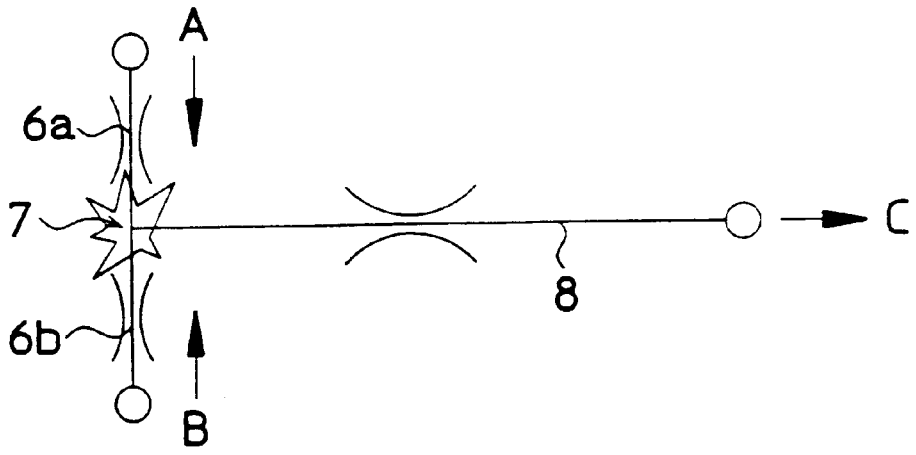
FIG. 8 is a conceptual diagram illustrating another flow control conducted for produced particles.
Figure 9:
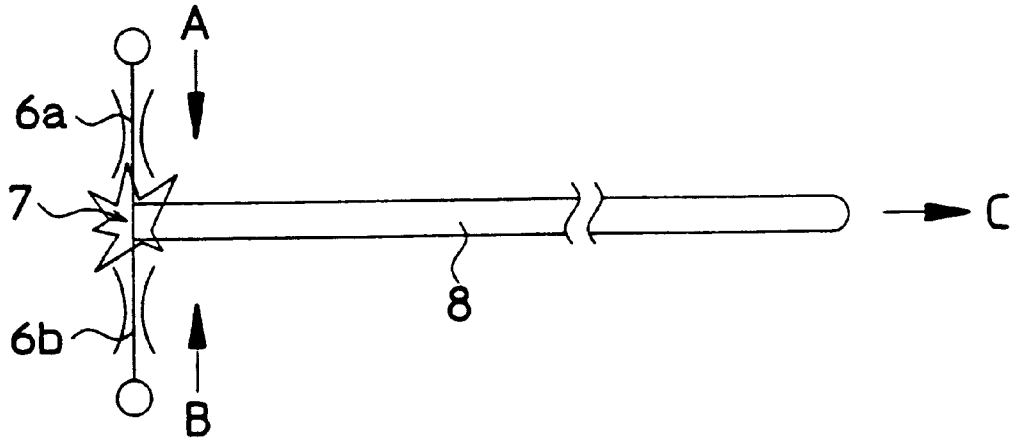
FIG. 9 is a conceptual diagram illustrating still another flow control conducted for produced particles.

Although the feature of the method of the present invention is that two or more substances are squarely collided against each other along substantially a straight line at high speed, the construction of the outflow of the reaction product is not limited to the specific model, but may be modified into various arrangements. For example, as shown in FIGS. 7 to 9, a reaction product C may be passed through another arrangement in accordance with the characteristics of the reaction product C. To further reduce the size of the reaction product C or to make finer particles, a throttling portion 8 may be formed at an immediate downstream location of the joining portion 7 as shown in FIG. 7, or at a downstream location slightly away from the joining portion 7 as shown in FIG. 8. Also, it may be appreciated, as shown in FIG. 9, to broaden the outflow channel downstream of the joining portion 7 to reduce the pressure of the downstream side, and thereby enhance the collision reaction and make the flow of reaction product C smoother.

Furthermore, according to the present invention, there may be various modification of the high speed collision reaction as follows.

Figure 10:
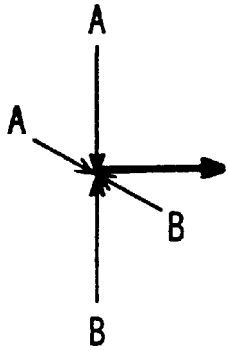
FIG. 10 is a conceptual diagram illustrating a second high speed collision reaction manner embodying the present invention.

As shown in FIG. 10, two reactants A and B collide in two opposite directions at the same time at a high speed.

Figure 11:
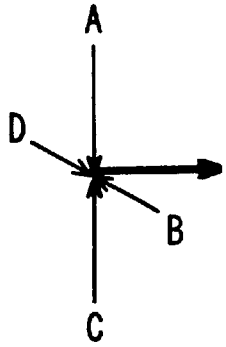
FIG. 11 is a conceptual diagram illustrating a third high speed collision reaction manner embodying the present invention.

As shown in FIG. 11, four reactants A to D collide in two opposite directions at the same time at a high speed.

Figure 12:
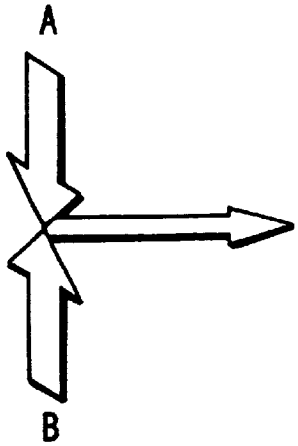
FIG. 12 is a conceptual diagram illustrating a fourth high speed collision reaction manner embodying the present invention.
Figure 13:
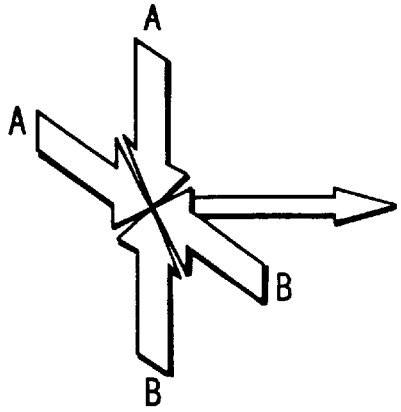
FIG. 13 is a conceptual diagram illustrating a fifth high speed collision reaction manner embodying the present invention.

As shown in FIGS. 12 and 13, two reactants A and B collide by ejecting them from oppositely arranged slit nozzles at a high speed.

Figure 14:
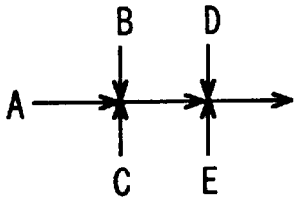
FIG. 14 is a conceptual diagram illustrating a sixth high speed collision reaction manner embodying the present invention.

As shown in FIG. 14, while a reactant A is flowed in a specified direction at a high rate of speed, four reactants B, C, D, and E are directed to the flow of the substance A at a high flow rate. In this case, the flows of the substances B and C, and the flows of the substances D and E face each other.

Figure 16:
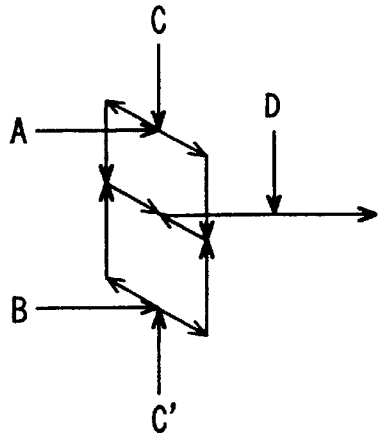
FIG. 16 is a conceptual diagram illustrating a seventh high speed collision reaction manner embodying the present invention.

As shown in FIG. 16, reactants A and B are respectively branched into two flow paths and collide at two points. After that, the reaction product collides again in a downstream and then is discharged in a single path.

Figure 18:
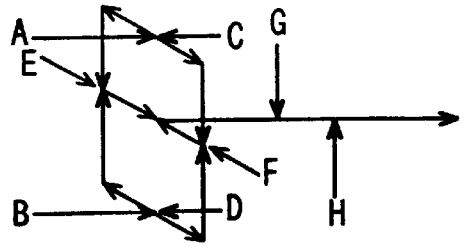
FIG. 18 is a conceptual diagram illustrating an eighth high speed collision reaction manner embodying the present invention.

As shown in FIG. 18, reactants A and C, and reactants B and D are respectively collided against each other at different positions. Thereafter, reaction product AC and reaction product BD are respectively branched into two flow paths, and collided against each other at two different points. Reaction product ABCD is collided against each other more downstream, and then discharged in a single flow path.

In the reaction manner shown in FIG. 14, the substance A may be a reaction medium, and the substances D and E may be primary substances. Prior to collision, reaction between the substances D and E using the substance A as a reaction medium, the substances B and C, such as a surface active agent (dispersing agent etc.), reaction accelerator, reaction auxiliary agent, or catalyst may be added and dispersed in the flow of the substance A. Alternatively, the substance A may be a reaction medium, and the substances B and C may be primary reactants. The substances D and E may be a reaction shortstop agent, a secondary reactive substance, a finishing agent, or a modifier and the like, and may be added downstream of the reaction of the substances B and C.

Such addition can be applied for the reaction manner shown in FIG. 16. More specifically, prior to the collision reaction between the substances A and B, substances C and C', such as a surface active agent (dispersing agent etch), reaction accelerator, reaction auxiliary agent, or catalyst may be added to the substances A and B, respectively. Alternatively, a substance D, such as a reaction shortstop agent, secondary reactive substance, finishing agent, or modifier may be added to the reaction product of A and B.

Also, such addition can be applied for the reaction manner shown in FIG. 18. More specifically, prior to the collision reaction between substances A and B, substances C and D, such as a surface active agent (dispersing agent etc.), reaction accelerator, reaction auxiliary agent, or catalyst may be added to the flows of the substances A and 5, respectively. In addition, during the collision reaction between the reaction products AC and BD, substances E and F, such as a surface active agent (dispersing agent etc.), reaction accelerator, reaction auxiliary agent, or catalyst may be added to the flows of the substances AC and BD, respectively. Further, substances G and H, such as a reaction shortstop agent, secondary reactive substance, finishing agent, or modifier may be added to the flow of the reaction product.

Figure 15:
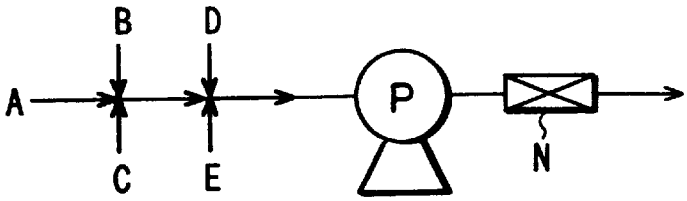
FIG. 15 is a conceptual diagram showing a first combination of a high speed collision reaction and an emulsion dispersion.
Figure 17:
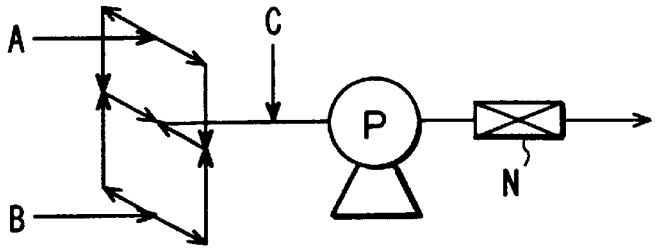
FIG. 17 is a conceptual diagram illustrating a second combination of a high speed collision reaction and an emulsion dispersion.
Figure 19:
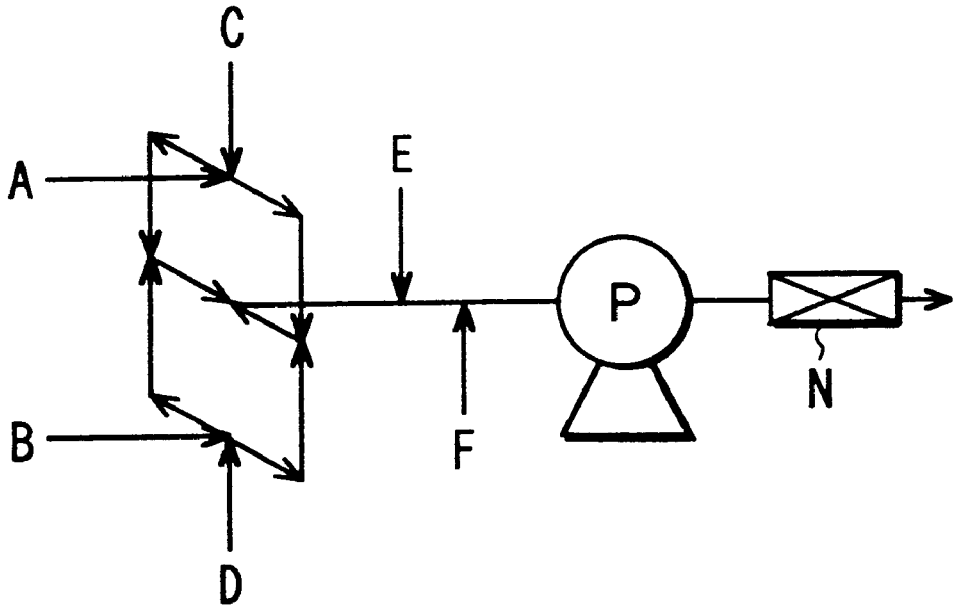
FIG. 19 is a conceptual diagram illustrating a third combination of a high speed collision reaction and an emulsion dispersion.

Furthermore, as shown in FIGS. 15, 17, and 19, a pump P is provided for pressurizing fluid containing particles of reaction product produced by the reaction shown in FIGS. 14, 16, and 18, and a dispersing apparatus N, e.g., a dispersing apparatus disclosed in Japanese Unexamined Patent Publication No. 9-201522, is provided to thereby increase the stability of a dispersion containing fine particles.

Figure 20:
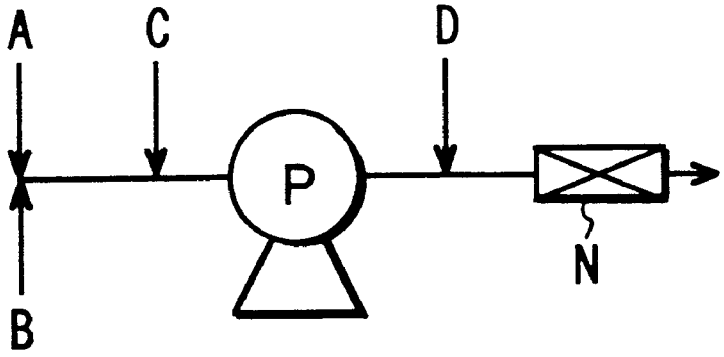
FIG. 20 is a conceptual diagram illustrating a fourth combination of a high speed collision reaction and an emulsion dispersion.

FIG. 20 shows still another collision reaction of the present invention. A reaction product of substances A and B is added with a surface active agent, such as a dispersing agent, a reaction shortstop agent, a second order substance, a finishing agent, or a modifier upstream and/or downstream of a pump P. The resultant is introduced into a dispersing apparatus N. This will more reliably prevent very fine reaction product particles from agglutinating.

Examples of means of supplying reactants include a plunger pump, snake pump, diaphragm pump, centrifugal pump, or the like in consideration of the kind and flowability of substance. Where the reactant is in the form of a gas or mist, a high pressure pump may be used. The flow rate of reactants before collision is controlled by adjusting the supplying pressure of the supply means and the section area of the flow passage. Also, the pressure of the outflow of reaction product is controlled in a range of 0.1 to 300 Mpa by adjusting the section area of the outflow passage.

The flow in the outflow passage is substantially identical to the flow in the inflow passage where the reactants are liquid. In the case of at least one reactant being a gas, however, the flow in the outflow passage is greatly different from or is remarkably smaller than the flow in the inflow passage, because the gaseous substance converts into the liquid or solid state after reaction. Accordingly, the supplying pressure and flow section area are determined in consideration of a phase change after reaction.

The high speed collision reaction occurs in the joining portion 7 where a high energy consequently generates. The inner surface of the joining portion 7 is subjected to severe abrasion. Therefore, the joining portion 7 is required to have a resistance to abrasion. Also, depending on characteristics of reactants and reaction product, the joining portion 7 is required to have a resistance to acid and alkaline chemicals, to solvents, and to heat. These requirements are satisfied by forming or depositing the chemically exposed portion of the joining portion 7 with durable materials, e.g., cemented carbides such as WC, abrasion-resistant ceramics such as zircon, alumina, boron carbide, sintered diamond, or monocrystalline diamond.

The high speed collision reactions of the present invention can be applied for a wide variety of substances which can be supplied under pressure, such as liquid substances, solutions, emulsions, suspensions, sol-gel liquids, gases, or gases containing mists.

As described above, according to the present invention, substances are collided in the joining portion 7 at a high speed to react with each other for a very short time. Reaction product is discharged out of the reactor through the outflow passage 9 without being held in the reaction system immediately after the reaction. This arrangement is highly advantageous for producing very fine particles. More specifically, in the conventional batch-type method and agitation flow passage method, reaction between substances gradually proceeds. Accordingly, a variation in the reaction conditions, such as substance concentration, inevitably occurs as time passes, consequently causing aggregation of substances. On the other hand, in the method of the present invention, collision and reaction between substances are made in an extremely small space for a very short time, thus making it possible to produce very fine particles without forming aggregations.

Furthermore, in the conventional batch-type method and the agitation flow passage method, it is difficult to control the temperature of the reaction system, such as a momentary increase and decrease in temperature, because the amount of substance residing in the reaction system, the residence time of substance in the reaction system, and the size and heat capacity of the reactor vary depending on each case. As a result, increases in equipment costs and energy costs are inevitable. On the other hand, in the method of the present invention, collision reaction occurs in an extremely small space for a very short time. The temperature control of the small space can be more efficiently conducted by providing a heating device and a cooling device for the small space, thus assuring uniform reaction. Moreover, the method of the present invention is very effective where the reaction product is liable to change its characteristics as the temperature varies.

In the fine particles fields, such as medicine industries, food industries, and electronic materials industries, contamination by foreign matters and bacteria causes serious problems. The method of the present invention enables instantaneous reaction in a perfect closed space completely blocked from the atmosphere. Accordingly, the inventive method can more effectively and easily eliminate this problem by only keeping the substance supplying system from being contaminated. Also, in the medicine and food industries, it has been confirmed that a sterilizing effect can be obtained by application of high pressure. Accordingly, the inventive method can additionally provide sterilization owing to the high pressure.

In a chemical reaction, the reaction efficiency between a gas and a liquid, and between a gas, a liquid, and a solid greatly depends on the solubility of gas in liquid. In other words, the reaction efficiency is increased by increasing the concentration of gas in liquid. In the inventive method, the solubility of gas in liquid can be easily increased by supplying substances under high pressure. This makes it possible to easily increase the efficiency of a reaction when using a gaseous substance.

The method of the present invention is applicable to a wide variety of reactions, such as liquid and liquid reaction, gas and liquid reaction, or gas and gas reaction, by effectively utilizing the above-described advantageous features of the method in the various industrial fields of producing medicines, foods, paints, inks, pigments, photosensitive materials, magnetic recording mediums, and the like. It should be noted that in the present invention, the term "liquid" includes not only a substance in the form of liquid, but also a solution in which a reactant is dissolved in an arbitrary solvent, an emulsion, a suspension, latex and the like.

In particular, the method of the present invention is remarkably advantageous in reactions in which two or more liquid substances are reacted with each other to produce insoluble fine particles or an emulsion. As described above, the inventive method can produce very fine particles the size of submicrons by the high speed collision, and particularly a dispersion in which the resulting insoluble fine particles are dispersed in a solvent. Accordingly, the inventive method can produce an extremely stable dispersion liquid and emulsion more easily.

Examples of reactions using the method of the present invention follow. It is understood, however, that the present invention is not limited to these reactions.

- A reaction between an aqueous solution of $CaCl_2$ and an aqueous solution of $NaCO_3$ to produce fine particles of $CaCO_3$;
- A reaction between an aqueous solution of $BaCl_2$ and an aqueous solution of $NaCO_3$ to produce fine particles of $BaCO_3$;
- A reaction between an aqueous solution of $BaCl_2$ and an aqueous solution of $H_2SO_4$ (or $NaSO_4$) to produce fine particles of $BaSO_4$;
- A reaction between an aqueous solution of $ZnSO_4$ and an aqueous solution of $NaCO_3$ to produce fine particles of $ZnCO_3$;
- A reaction between an aqueous solution of $ZnSO_4$ and an aqueous solution of $Na_2S_x$ (or $NH_4S_x$) to produce fine particles of ZnS;
- A reaction between an aqueous solution of $Na_2O{\cdot}3.3SiO_2$ and an aqueous solution of $H_2SO_4$ to produce $SiO_2$ in the form of a sol; and
- A reaction between an aqueous solution of $ZnSO_4$ and an aqueous solution of NaOH to produce fine particles of $Zn(OH)_2$. Fine particles of ZnO are obtained by decomposing $Zn(OH)_2$ by heat.

The method of the present invention will be described in more detail by way of examples. It is to be understood, however, that various changes and modifications will be apparent to those skilled in the art. Therefore, unless such changes and modifications depart from the scope of the present invention, they should be construed as being included therein.

Using the reactor shown in FIG. 1, two substances were respectively supplied at a specified speed through the inflow passages, and were collided and reacted with each other at the joining portion. Reaction product was discharged through the outflow passage. The particle diameter of the reaction product was measured using a laser diffraction-type particle size distribution measuring device "SALD-2000A" manufactured by Shimazu Corporation. For comparison, another reaction was conducted using a batch-type agitation table reactor "AM-9" manufactured by Nippon Seiki Co., Ltd., and the particle diameter of the reaction product was measured in the same manner. Both the two inflow passages for supplying substances to the joining portion had a length of 7.5 mm and a diameter of 1.0 mm (i.e., a sectional area of $3.93\times10^{-7}$ $m^2$). The outflow passage for discharging reaction product from the joining portion had a length of 15 mm and a diameter of 1.8 mm (i.e., a sectional area of $1,27\times10^{-6}$ $m^2$).

EXAMPLE 1

Relationship Between the Flow Rate and the Size of Produced Particle in the Production of Barium Sulfate Test samples:

- barium chloride dihydrate (produced by Wako Pure Chemical Industries, Ltd.)
- sodium sulfate (produced by Wako Pure Chemical Industries, Ltd.)
- a surface active agent (a polycarboxylic acid-type surface active agent manufactured by the Kao Corporation under the trademark "Demol EP")
- pure water Procedure of Test (1) 18 weight percent of barium chloride aqueous solution and 9 weight percent of sodium sulfate aqueous solution were respectively prepared.

(2) 300 g of the respective aqueous solutions prepared in step (1) were diluted with pure water to 400 ml.

(3) The respective aqueous solutions prepared in step (2) were supplied through the inflow passages under pressure, and were collided at the flow rates shown in Table 1 to obtain a dispersion liquid containing dispersed particles of barium sulfate.

(4) The surface active agent was dissolved in the sodium sulfate aqueous solution in such a manner that its concentration is 0.1 weight percent in the dispersion liquid after the reaction.

The test results are shown in Table 1 and FIG. 6. Specifically, at the flow rate of less than 4 m/sec, the barium sulfate had an average particle diameter as large as 3 $\mu$m or larger. Contrary to this, at the flow rate of 4 m/sec or higher, the average particle diameter was as small as about 1 $\mu$m or smaller. At the flow rate of 7 m/sec or higher, the average particle diameter was 0.5 $\mu$m or smaller. At the flow rate of 15 m/sec or higher, the average particle diameter was 0.2 $\mu$m or smaller.

TABLE 1

| Flow amount (ml/min) | Flow rate (m/sec) | Average particle diameter ($\mu$m) | 10% particle diameter ($\mu$m) | 90% particle diameter ($\mu$m) |
|---|---|---|---|---|
| 25 | 1.1 | 4.18 | 0.36 | 32.16 |
| 50 | 2.1 | 3.39 | 0.29 | 12.89 |
| 100 | 4.2 | 1.13 | 0.23 | 4.21 |
| 200 | 8.5 | 0.36 | 0.16 | 1.04 |
| 300 | 12.7 | 0.29 | 0.11 | 0.44 |
| 400 | 17.0 | 0.14 | 0.06 | 0.27 |
| 500 | 21.2 | 0.12 | 0.05 | 0.20 |
| 600 | 25.5 | 0.07 | 0.03 | 0.15 |
| 700 | 29.7 | 0.04 | 0.02 | 0.13 |

EXAMPLE 2

Production of Barium Sulfate

Test samples:

- barium chloride dihydrate (produced by Wako Pure Chemical Industries, Ltd.)
- sodium sulfate (produced by Wako Pure Chemical Industries, Ltd.)
- a surface active agent (a polycarboxylic acid-type surface active agent manufactured by the Kao Corporation under the trademark "Demol EP")
- pure water Procedure of Test A: Inventive method (1) 18 weight percent of barium chloride aqueous solution and 12 weight percent of sodium sulfate aqueous solution were respectively prepared.

(2) 300 g of the respective aqueous solutions prepared in step (1) were diluted with pure water to 400 ml.

(3) The respective aqueous solutions prepared in step (2) were supplied through the inflow passages under pressure, and were collided at the flow rate of 25.5 m/sec or 600 ml/sec to obtain a dispersion liquid containing dispersed particles of barium sulfate.

(4) The surface active agent was dissolved in the sodium sulfate aqueous solution in such a manner that its concentration becomes 0.1 weight percent in the dispersion liquid after the reaction.

B: Comparative method (batch-type agitation table reactor)

(1) 18 weight percent of barium chloride aqueous solution and 12 weight percent of sodium sulfate aqueous solution were respectively prepared.

(2) 150 g of the respective aqueous solutions prepared in step (1) were removed.

(3) 100 g of pure water was put in the reactor in which the respective aqueous solutions removed in step (2) were simultaneously added into the reactor while driving an agitator at 5000 r.p.m., and maintained with each other for 30 minutes.

(4) The surface active agent was dissolved in the sodium sulfate aqueous solution in such a manner that its concentration is 0.1 weight percent in the dispersion liquid after the reaction.

The test results are shown in Table 2. It is found that the method of the present invention can produce barium sulfate in the form of extremely fine particles, as compared with the conventional batch-type agitation.

TABLE 2

| Method | Median diameter (μm) | 10% diameter/ 90% diameter (μm) |
|---|---|---|
| Inventive method | 0.09 | 0.05/0.11 |
| Comparative method | 1.06 | 0.39/2.53 |

TABLE 3

| Method | Median diameter (μm) | 10% diameter/ 90% diameter (μm) |
|---|---|---|
| Inventive method | 0.19 | 0.13/0.28 |
| Comparative method | 2.93 | 0.41/5.61 |

EXAMPLE 3

Production of Barium Carbonate

Test samples:

barium chloride dihydrate (produced by Wako Pure Chemical Industries, Ltd.)

sodium carbonate (produced by Wako Pure Chemical Industries, Ltd.)

a surface active agent (a polycarboxylic acid-type surface active agent manufactured by the Kao Corporation under the trademark "Demol EP")

pure water

Procedure of Test

A: Inventive method (1) 18 weight percent of barium chloride aqueous solution and 9 weight percent of sodium carbonate aqueous solution were respectively prepared.

(2) 300 g of the respective aqueous solutions prepared in step (1) were diluted with pure water to 400 ml.

(3) The respective aqueous solutions prepared in step (2) were supplied through the inflow passages under pressure, and were collided at the flow rate of 25.5 m/sec or 600 ml/sec to obtain a dispersion liquid containing dispersed particles of barium carbonate.

(4) The surface active agent was dissolved in the sodium carbonate aqueous solution in such a manner that its concentration is 0.1 weight percent in the dispersion liquid after the reaction.

B. Comparative method (batch-type agitation table reactor)

(1) 18 weight percent of barium chloride aqueous solution and 9 weight percent of sodium carbonate aqueous solution were respectively prep area.

(2) 150 g of the respective aqueous solutions in step (1) were removed.

(3) 100 g of pure water was put in the reactor in which the respective aqueous solutions removed in step (2) were simultaneously added into the reactor while driving an agitator at 5000 r.p.m., and maintained with each other for 30 minutes.

(4) The surface active agent was dissolved in the sodium carbonate aqueous solution to a concentration of 0.1 weight percent in the dispersion liquid after the reaction.

The test results are shown in Table 3. It is found that the method of the present invention can produce barium carbonate in the form of extremely fine particles, as compared with the conventional batch-type agitation.

EXAMPLE 4

Production of Calcium Carbonate

Test samples:

calcium chloride dihydrate (produced by Wako Pure Chemical Industries, Ltd.)

sodium carbonate (produced by Wako Pure Chemical Industries, Ltd.)

a surface active agent (a polycarboxylic acid-type surface active agent manufactured by the Kao Corporation under the trademark "Demol EP")

pure water

Procedure of Test

A: Inventive method (1) 16.5 weight percent of calcium chloride aqueous solution and 16 weight percent of sodium carbonate aqueous solution were respectively prepared.

(2) 300 g of the respective aqueous solutions prepared in step (1) were diluted with pure water to 400 ml.

(3) The respective aqueous solutions prepared in step (2) were supplied through the inflow passages under pressure, and were collided at the flow rate of 25.5 m/sec or 600 ml/sec to obtain a dispersion liquid containing particles of calcium carbonate.

(4) The surface active agent was dissolved in the sodium carbonate aqueous solution to a concentration of 0.1 weight percent in the dispersion liquid after the reaction.

B: Comparative method (batch-type agitation table reactor)

(1) 18.5 weight percent of calcium chloride aqueous solution and 15 weight percent of sodium carbonate aqueous solution were respectively prepared.

(2) 150 g of the respective aqueous solutions prepared in step (1) were separated out.

(3) 100 g of pure water was put in the reactor in which the respective aqueous solutions separated out in step (2) were simultaneously added into the reactor while driving an agitator at 5000 r.p.m., and maintained with each other for 40 minutes.

(4) The surface active agent was dissolved in the sodium carbonate aqueous solution to a concentration of 0.1 weight percent in the dispersion liquid after the reaction.

The test results are shown in Table 4. It is found that the method of the present invention can produce calcium carbonate in the form of extremely fine particles, as compared with the conventional batch-type agitation.

TABLE 4

| Method | Median diameter (μm) | 10% diameter/ 90% diameter (μm) |
|---|---|---|
| Inventive method | 0.05 | 0.03/0.11 |
| Comparative method | 0.26 | 0.09/2.01 |

TABLE 5

| Method | Median diameter (μm) | 10% diameter/ 90% diameter (μm) |
|---|---|---|
| Inventive method | 0.07 | 0.03/0.09 |
| Comparative method | 1.40 | 0.31/4.52 |

EXAMPLE 5

Production of Zinc Sulfide

Test samples:

zinc sulfate heptahydrate (produced by Wako Pure Chemical Industries, Ltd.)

sodium sulfide (produced by Wako Pure Chemical Industries, Ltd.)

a surface active agent (a polycarboxylic acid type surface active agent manufactured by the Kao Corporation under the trademark "Demol EP")

pure water

Procedure of Test

A: Inventive method (1) 24 weight percent of zinc sulfate aqueous solution and 12 weight percent of sodium sulfide aqueous solution were respectively prepared.

(2) 300 g of the respective aqueous solutions prepared in step (1) were diluted with pure water to 400 ml.

(3) The respective aqueous solutions prepared in step (2) were supplied through the inflow passages under pressure, and were collided at the flow rate of 25.5 m/sec or 600 ml/sec to obtain a dispersion liquid containing dispersed particles of zinc sulfide.

(4) The surface active agent was dissolved in the sodium sulfide aqueous solution to a concentration of 0.1 weight percent in the dispersion liquid after the reaction.

B: Comparative method (batch-type agitation table reactor)

(1) 24 weight percent of sodium sulfate aqueous solution and 12 weight percent of sodium sulfide aqueous solution were respectively prepared.

(2) 150 g of the respective aqueous solutions prepared in step (1) were separated out.

(3) 100 g of pure water was put in the reactor in which the respective aqueous solutions separated out in step (2) were simultaneously added into the reactor while driving an agitator at 5000 r.p.m., and maintained with each other for 25 minutes.

(4) The surface active agent was dissolved in the sodium sulfide aqueous solution to a concentration of 0.1 weight percent in the dispersion liquid after the reaction The test results are shown in Table 5. It is found that the method of the present invention can produce zinc sulfide in the form of extremely fine particles, as compared with the conventional batch-type agitation.

EXAMPLE 6

Production of Zinc Hydroxide and Zinc Oxide

Test samples:

zinc sulfate heptahydrate (produced by Wako Pure Chemical Industries, Ltd.)

sodium hydroxide (produced by Wako Pure, Chemical Industries, Ltd.)

a surface active agent (a polycarboxylic acid-type surface active agent manufactured by the Kao Corporation under the trademark "Demol EP")

pure water

Procedure of Test

A: Inventive method (1) 24 weight percent of zinc sulfate aqueous solution and 12 weight percent of sodium hydroxide aqueous solution were respectively prep area.

(2) 300 g of the respective aqueous solutions prepared in step (1) were diluted with pure water to 400 ml.

(3) The respective aqueous solutions prepared in step (2) were supplied through the inflow passages under pressure, and were collided at the flow rate of 25.5 m/sec or 600 ml/sec to obtain a dispersion liquid containing dispersed particles of calcium carbonate.

(4) The surface active agent was dissolved in the sodium hydroxide aqueous solution to a concentration of 0.1 weight percent in the dispersion liquid after the reaction.

B: Comparative method (batch-type agitation table reactor)

(1) 24 weight percent of zinc sulfate aqueous solution and 12 weight percent of sodium hydroxide aqueous solution were respectively prepared.

(2) 150 g of the respective aqueous prepared in step (1) were separated out.

(3) 100 g of pure water was put in the reactor in which the respective aqueous solutions separated out in step (2) were simultaneously added into the reactor while driving an agitator at 5000 r.p.m., and maintained with each other for 30 minutes.

(4) The surface active agent was dissolved in the sodium hydroxide aqueous solution to a concentration of 0.1 weight percent in the dispersion liquid after the reaction.

The dispersion liquids produced by the inventive method and the comparative method were respectively dried under a reduced pressure while being agitated, and further dried at 120° C. for one hour to obtain fine particles of zinc oxide.

The size of the particles of zinc hydroxide contained in the dispersion liquid and the size of the particles of zinc oxide obtained by the heat-decomposition are shown in Table 6. It is found that the method of the present invention can produce zinc hydroxide and zinc oxide in the form of extremely fine particles, as compared with the conventional batch-type agitation.

TABLE 6

| | Method | Median diameter (μm) | 10% diameter/90% diameter (μm) |
|---|---|---|---|
| Zinc hydroxide | Inventive method | 0.07 | 0.04/0.12 |
| | Comparative Method | 0.23 | 0.11/3.42 |
| Zinc oxide | Inventive method | 0.05 | 0.03/0.10 |
| | Comparative method | 0.14 | 0.07/2.92 |

As described above, in the method of the present invention, two or more substances having reactivity with each other are supplied through different inflow passages to a joining portion. In the joining portion, the substances are collided against each other at a flow rate of 4 m/sec or higher to cause reaction with each other for a short time. Accordingly, uniform reactions occur at high efficiency.

In the case of a reaction producing an insoluble reaction product, such as fine particles, emulsion, or latex, the method of the present invention is advantageous in that the high speed collision generates great collision energy, and then turbulence and shearing forces, thus preventing aggregation. In other words, the inventive method can produce a dispersion liquid containing very fine particles the size of submicrons at a remarkably high efficiency.

Further, the method of the present invention can maintain the reaction system under constant conditions or avoid such physical and chemical changes, such as variations in the amount and concentration of reactive substances, or in pH.

Furthermore, the method of the present invention can provide sterilizing effects because of the high speed collision.

Moreover, the reaction chamber where the high collision reaction occurs is very small. Accordingly, the reaction temperature can be more easily and accurately controlled by providing heating and cooling to the reaction chamber.

What is claimed is:

1. A method of producing a substance of fine particles comprising:

introducing first and second inorganic reactants each dissolved in a solvent into respective first and second longitudinally extending colinear path each having path-defining boundaries and each having a substantially equal and constant traverse cross sectional area along the longitudinal thereof;

flowing said first and second reactants substantially colinearly along said first and second colinear path respectively toward a collision enclosure having an enclosure-defining boundary which is co-extensive and colinear with said path-defining boundaries such that the traverse cross sectional area of said enclosure defining boundary is substantially equal to said traverse cross sectional area of said path-defining boundaries;

ejecting said first and said reactants into said reactants into said collision enclosure;

colliding said first and second reactants head on within said collision enclosure;

effecting a substantially instantaneously chemical reaction between said first and second reactants in said collision enclosure as a result of said head-on collision;

producing a substance of fine particles in said collision enclosure as a result of said reaction in said collision enclosure;

substantially immediately after producing said collision substance conducting said substance from said collision enclosure into a longitudinally extending outlet path having a path-defining boundary in which the outlet path extends laterally of said first and second colinear paths; and effecting the aforesaid steps continually and non-cyclically.

2. A method according to claim 1, wherein the speed at which said reactants collide is 4 m/sec or higher.

3. A method according to claim 1, wherein the speed at which said reactants collide is 7 m/sec or higher.

4. A method according to claim 1, further comprising the step of adding a dispersing agent before the collision reaction.

5. A method according to claim 1, further comprising the step of adding a dispersing agent after the collision reaction.

6. A method according to claim 1, further comprising the step of adding a dispersing agent before and after the collision reaction.

7. A method according to claim 1 further comprising reducing the average particle size of said substance by throttling said substance as said substance is removed from said collision enclosure.

8. A method according to claim 1 further comprising introducing a third reactant into said collision enclosure along a third linear path, said third linear path being perpendicular to said colinear first and second paths, and introducing a fourth reactant into said collision enclosure along a fourth linear path, said fourth linear path being perpendicular to said colinear first and second paths.

9. A method according to claim 1 wherein said substance is a first substance, and further comprising conducting said first substance along said outlet path to a second collision enclosure, directing a third reactant to said second collision enclosure, colliding said third reactant and said first substance in said second collision enclosure, effecting a further reaction between said third reactant and said first substance in said second collision enclosure to obtain a second substance of fine particles, and directing said second substance from said second collision enclosure.

10. A method according to claim 1 where said step of ejecting a first reactant into said collision enclosure comprises ejecting a first liquid reactant into said collision enclosure at a first flow rate, said step of ejecting a second reactant into said collision enclosure comprising ejecting a second liquid reactant into said collision enclosure at a second flow rate, said step of conducting said substance from the collision enclosure comprising removing a liquid substance from the collision enclosure at a flow rate substantially equal to the sum of said first and second flow rates.

11. A method according to claim 1 wherein said outlet path extends substantial perpendicular relative to said first and second colinear paths.

12. A method according to claim 1 wherein said collision enclosure is a generally T-shaped collision enclosure.

13. The method of claim 1 wherein:

said at least one reactant includes an inorganic compound dissolved in a specified solvent; and said at least one other reactant includes a second inorganic compound dissolved in a specified solvent.

14. A method according to claim 1 wherein the solvent in which said first reactant is dissolved is different from the solvent in which said second reactant is dissolved.

15. A method according to claim 1 wherein the solvent in which said first reactant is dissolved is the same as the solvent in which said second reactant is dissolved.

16. A method according to claim 1 wherein said substance of fine particles is insoluble in the solvent in which the first and second reactants are dissolved.

17. A method according to claim 1 wherein said step of producing said substance of fine particles comprises producing fine particles having an average particle diameter of about 1.0 μm or smaller.

18. A method according to claim 1 wherein said step of producing said substance of fine particles comprises producing fine particles having an average particle diameter of about 0.5 μm or smaller.

19. A method according to claim 1 wherein said step of producing said substance of fine particles comprises producing fine particles having an average particle diameter of about 0.2 μm or smaller.

20. A method of reacting two or more reactants to produce a reactant product of fine particles comprising:

introducing flowing materials along first, second, third and fourth inlet passages respectively into a collision enclosure, at least two of said flowing materials being inorganic reactants dissolved in a solvent;

effecting a head-on collision between said at least two introduced reactants within said collision enclosure;

effecting a substantially instantaneous chemical reaction between said at least two introduced reactants to produce a reaction product of fine particles;

substantially immediately removing the reaction product from the collision enclosure via an outlet passage; and effecting said introducing step and said removing step continuously and non-cyclically.

21. A method according to claim 20 wherein said first and third flowing materials are substantially the same and said second and fourth flowing materials are substantially the same.

22. A method according to claim 20 wherein said first to fourth reactants are different from one another.

23. A method of reacting two or more reactants comprising directing a first reactant along a first linear path to a collision enclosure, directing a second reactant along a second linear path to said collision enclosure, said first and second linear paths being substantially colinear, directing a third reactant to said collision enclosure along a third linear path, said third linear path being perpendicular to said colinear path, directing a fourth reactant to said collision enclosure along a fourth linear path, said fourth linear path being perpendicular to said colinear path, said first and third reactants being the same and said second and fourth reactants being the same, colliding said first and second reactants and said third and fourth reactants in said collision enclosure, effecting a reaction between said first and second reactants and between said third and fourth reactants during said colliding of said first and second reactants and said third and fourth reactants in said collision enclosure to obtain a reaction product, directing said reaction product from said collision enclosure, and effecting the aforesaid steps continuously and non-cyclically to produce the reaction product continuously and non-cyclically.

24. A method of producing a reaction product of final particles comprising:

introducing first and second inorganic reactants each dissolved in a solvent into respective first and second longitudinally extending colinear passages each having passage-defining boundaries formed by passage walls, flowing said first and second reactants substantially colinearly along said first and second colinear passages respectively at a flow rate of 4 m/sec or higher toward a collision enclosure having an enclosure-defining boundary which is co-extensive and colinear with said passage-defining boundaries;

ejecting said first and second reactants into said collision enclosure at a flow rate of 4 m/sec or higher;

effecting a head-on collision of said colinearly flowing first and second reactants within said co-extensive and colinear enclosure-defining boundary of said collision enclosure;

effecting a substantially instantaneously chemical reaction between said first and second reactants in said collision enclosure as a result of said head-on collision;

producing a reaction product of fine particles having an average partials size of 1.0 μm or less in said collision enclosure as a result of said reaction in said collision enclosure;

substantially immediately after producing said reaction-product conducting said reaction product from said collision enclosure into a longitudinally extending outlet path having a path-defining boundary in which the outlet path extends laterally of said first and second colinear passages; and effecting the aforesaid steps continually and non-cyclically.

25. A method according to claim 24 wherein said substance is a first substance, further comprising directing said first substance to a second collision enclosure, directing a third reactant to said second collision enclosure, effecting a reaction between said first substance and said third reactant during said colliding in said second collision enclosure to obtain a second substance of fine particles, and directing said second substance from said second collision enclosure.

26. A method according to claim 24 further comprising reducing the particle size of said reaction product by throttling said reaction product as the reaction product flows in said outlet path.

27. A method according to claim 24 further comprising reducing the particle size of said reaction product by increasing the flow rate of said first and second reactants in said respective first and second passages.

28. A method of reacting two or more reactants comprising directing a first organic reactant dissolved in a solvent along a first linear path to a collision enclosure, directing a second organic reactant dissolved in a solvent along a second linear path to said collision enclosure, said first and second linear paths being substantially colinear, directing a third organic reactant dissolved in a solvent to said collision enclosure along a third linear path, said third linear path being perpendicular to said colinear path, directing a fourth organic reactant dissolved in a solvent to said collision enclosure along a fourth linear path, said fourth linear path being perpendicular to said colinear path, said first and third reactants being the same and said second and fourth reactants being the same, colliding said first and second reactants head-on and said third and fourth reactants head-on in said collision enclosure, effecting a chemical reaction between said first and second reactants and between said third and fourth reactants during said head-on colliding of said first and second reactants and said third and fourth reactants in said collision enclosure to obtain a reaction product, directing said reaction product from said collision enclosure, and effecting the aforesaid steps continuously and non-cyclically to produce the reaction product continuously and non-cyclically.

* * * * *